US009844098B2

(12) United States Patent
Köhler et al.

(10) Patent No.: US 9,844,098 B2
(45) Date of Patent: Dec. 12, 2017

(54) PLIABLE HEATING DEVICE

(75) Inventors: Ralf Köhler, Langenau (DE); Ernst Merk, Weißenhorn (DE); Thomas Wildermuth, Ulm (DE)

(73) Assignee: Beurer GmbH, Ulm (DE)

( * ) Notice: Subject to any disclaimer, the term of this patent is extended or adjusted under 35 U.S.C. 154(b) by 546 days.

(21) Appl. No.: 14/385,452

(22) PCT Filed: Mar. 14, 2012

(86) PCT No.: PCT/EP2012/054424

§ 371 (c)(1),
(2), (4) Date: Sep. 15, 2014

(87) PCT Pub. No.: WO2013/135280

PCT Pub. Date: Sep. 19, 2013

(65) Prior Publication Data

US 2015/0014303 A1 Jan. 15, 2015

(51) Int. Cl.
*H05B 3/44* (2006.01)
*H05B 3/56* (2006.01)
*H05B 1/02* (2006.01)

(52) U.S. Cl.
CPC ..... *H05B 3/56* (2013.01); *H05B 1/0252* (2013.01); *H05B 2203/019* (2013.01); *H05B 2203/02* (2013.01)

(58) Field of Classification Search
CPC ..... H05B 1/0252; H05B 3/34; H05B 3/56; H05B 2203/003; H05B 2203/009; H05B 2203/019; H05B 2203/02; H02H 5/043; H02H 5/044; H02H 5/047; H02H 5/00;
(Continued)

(56) References Cited

U.S. PATENT DOCUMENTS 4,205,223 A * 5/1980 Cole ..... H02H 5/043 219/212
2011/0259872 A1 10/2011 Wang et al.

FOREIGN PATENT DOCUMENTS

DE 10 2008 006017 A1 8/2009
GB 2 138 600 A 10/1984
(Continued)

*Primary Examiner* — Shawntina Fuqua
(74) *Attorney, Agent, or Firm* — Pauley Erickson & Kottis

(57) ABSTRACT

A pliable heating device having a flexible electrical heating apparatus, which is operated by a control device and which has at least one flexible heating element that is connected to a flexible support and that has a heating conductor, which is situated in a heating circuit, and a flexible sensor conductor, which is separated from the heating conductor by an intermediate insulation, having a dampable oscillator, which is contained in the control device and is connected to the sensor conductor and whose output signal can be varied as a function of various functional states of the heating apparatus, which functional states are detected by the sensor conductor, and having an evaluation device by which fault states can be detected from the output signal. In order to reliably detect function states, in particular fault states, the sensor conductor is connected at one end to the heating conductor via a resistor device which is connected in series to it and is of at least an ohmic, a capacitive, and/or an inductive sensor resistor, and is connected at the other end to the oscillator via an ohmic current-limiting resistor.

28 Claims, 5 Drawing Sheets

(58) Field of Classification Search
CPC ..... H02H 5/04; H02H 5/041; H02H 5/042;
G05D 23/24; G05D 23/2401
See application file for complete search history.

(56) References Cited

FOREIGN PATENT DOCUMENTS

| | | | |
|---|---|---|---|
| WO | WO 2004/107814 | A1 | 12/2004 |
| WO | WO 2005/118202 | A2 | 12/2005 |

* cited by examiner

PLIABLE HEATING DEVICE

BACKGROUND OF THE INVENTION

Field of the Invention

This invention relates to a pliable heating device having a flexible electrical heating apparatus, which is operated by a control device and which has at least one flexible heating element connected to a flexible support and that has a heating conductor situated in a heating circuit, and a flexible sensor conductor separated from the heating conductor by an intermediate insulation, having a dampable oscillator, which is contained in the control device and is connected to the sensor conductor and whose output signal can be varied as a function of various functional states of the heating apparatus. The functional states can be detected by the sensor conductor, and there is an evaluation device by which fault states can be detected from the output signal.

Discussion of Related Art

A pliable heating device is disclosed in German Patent Reference DE 10 2008 006 017 B4. In this known heating device, as in electric blankets, heating pads, and heated mattress covers, a heating element preferably embodied in the form of a heating cord is embedded in a flexible support. It has a heating conductor, a sensor conductor, an interposed electrically insulating intermediate layer, and an outer insulation layer. The heating conductor and the sensor conductor are connected to a control device that can control or regulate the heating operation and also can monitor the proper function of the heating device. In order to control or regulate the heating output, the control device has at least one circuit breaker situated in the same heating circuit as the heating conductor and can be controlled as a function of the desired heating output while complying with safety criteria. In order to detect functional states, in particular fault states, of the heating device, the sensor conductor is connected to a dampable oscillator circuit whose output signal is processed with regard to the functional states in an evaluation device. The output signal of the oscillator in this case also changes in particular as a function of different functional states of the intermediate insulation between the sensor conductor and the heating conductor, which insulation forms an essential sensor element and advantageously has a negative thermal response of its resistance value (NTC behavior), the temperature dependence is preferably exponential. The intermediate insulation can be used, for example, to ascertain locations with excessive heating of the heating element, so-called hot spots. The intermediate insulation can be embodied as fusing, such as irreversible and irreparable, thus making it possible to reliably detect mainly short circuits. It can also be embodied, for the usual temperatures that are to be detected, as non-fusing. If only the resistance change and not fusing is used in order to switch off the heating device, then a faulty functional state can be reversibly remedied. Other evaluation options and control options are achieved if the sensor conductor and/or the heating conductor has temperature-dependent resistance behavior, in particular a positive thermal response of the resistance value (PTC behavior). With this monitoring system that includes the oscillator circuit, it is possible to ascertain and differentiate among a variety of functional states. Depending on the functional state, the output signal of the oscillator can experience different signal changes, such as an amplitude change, a phase change, or a change in a pulse-pause ratio, which can be evaluated by the evaluation device individually or in various combinations in order to determine the functional state of the heating device. Pliable heating devices, however, are subject to a variety of influences such as aging, frequent washing, improper use, component tolerances, and the like, which also result in the signal changes of the oscillator and can lead to difficulties in evaluating states of the heating device and lack of reliability of the evaluations carried out and to associated incorrect interpretations.

In another pliable heating device disclosed by PCT Patent Reference WO 2005/118202 A2, the control device is embodied in a particular way to produce and evaluate a phase shift. In this device as well, there can be cases in which a fault recognition and evaluation are difficult.

U.S. Patent Application Publication 2011/259872 A1 discloses another pliable heating device in which the heating element is also embodied in the form of a heating cord that has a heating conductor, a sensor conductor, and an NTC intermediate insulation in order, for example, to be able to detect fault states and if necessary, to switch off the heating device. Here, also, the heating conductor and the sensor conductor can have a positive thermal response of their resistance value (PTC behavior) in order to thus control the heating output.

SUMMARY OF THE INVENTION

One object of this invention is to provide a pliable heating device of the type mentioned above but which fault states can be detected as reliably as possible and where it is possible to differentiate among various functional states as precisely as possible.

This object is attained with features discussed in this specification and in the claims. The sensor conductor can be connected at one end to the heating conductor via a resistor device which is connected in series to it and comprises at least an ohmic, capacitive, and/or inductive sensor resistor and is connected at the other end to the oscillator via an ohmic current-limiting resistor.

In experiments, the inventor of this invention has demonstrated that due to the above-mentioned arrangement of the sensor resistor, which can be embodied as ohmic, capacitive, and/or inductive, among other things the influences on the output signal of the oscillator caused by the intermediate insulation are significantly more pronounced in the oscillator than in previous embodiments and can be detected with greater sensitivity and differentiability and thus with greater reliability. In this connection, the sensor resistor enables an optimum adaptation between the heating apparatus and the control device. With the current-limiting resistor, the detected current can be adapted to a value that is advantageous for the operation of the heating apparatus and also for the evaluation by the oscillator. Different heating apparatuses can be adapted in an exact way with little effort by using different sensor resistors and/or current-limiting resistors for operation with the same control device.

One embodiment that is advantageous for the detection of different functional states includes the fact that the intermediate insulation has NTC resistance characteristics with an ohmic resistance that decreases exponentially as a function of the temperature or PTC resistance characteristics with an ohmic resistance that increases as a function of the temperature.

Advantages for the design and function can also be achieved if the control device has a control unit formed as or embodied in the form of an integrated circuit and at least a part of the oscillator comprises the integrated circuit. In this connection, it is possible to use circuit components that are already present in an integrated circuit, such as a microcontroller, to construct the oscillator. It is also possible, for example, to use software-based adjusting options for the oscillator, such as the fundamental frequency, the pulse-pause ratio, the fundamental amplitude, and similar parameters, in order to adjust the oscillator through programming.

Another advantageous option for adaptation between the oscillator and the heating apparatus includes the oscillator having an external oscillator resistor that is externally connected to the integrated circuit.

Another advantageous embodiment of the heating device includes a fundamental frequency of the oscillator that can be predetermined by the control unit. In this case, the fundamental frequency is defined by a predetermined standard condition, for example when the heating apparatus is not connected or when the heating apparatus is connected.

If the evaluation device is also supplied with a measurement signal that is picked up in the heating circuit and the evaluation device is embodied to determine fault states as a function of the output signal of the oscillator and also as a function of the measurement signal picked up in the heating circuit, then this offers a particularly wide variety of evaluation possibilities such as a differentiation between a breakage of the sensor conductor and an unplugged plug/coupling unit of the heating device.

In this case, it is advantageous for the design and function that the measurement signal be a current measurement signal that is picked up at a measurement resistor of the heating circuit and that is also used in the control unit to control or regulate the heating output by triggering a switch device contained in the heating circuit.

An advantageous embodiment of the heating device includes the sensor resistor and/or the current-limiting resistor situated on the flexible support or in a detachable divider of a plug/coupling unit mounted on it. If the sensor resistor and/or the current-limiting resistor is/are situated or positioned in the part of the plug/coupling unit that can be disconnected from the support, then the sensor resistor and/or the current-limiting resistor is/are removed before washing and thus not exposed to the washing process. The connection between the two parts of the plug/coupling unit for this purpose is produced, for example, by a four-pole plug connection.

An embodiment that is advantageous for the signal production in the oscillator and for the evaluation of the oscillator signal in the evaluation device includes the ohmic resistance value of the sensor resistor being in the range between one hundredth and one hundred percent of the ohmic resistance value of the intact intermediate insulation at room temperature, for example, between one twentieth or one twelfth and one half.

Another advantageous embodiment of the heating device includes the heating conductor, the sensor conductor, and the intermediate insulation situated between them as parts of a heating cord provided with an outer insulation on the outside.

Another embodiment that is advantageous for the control or regulation of the heating output and/or the differentiation among different functional states including fault states includes the heating conductor and/or the sensor conductor having a temperature-dependent ohmic resistance behavior. The thermal response of the resistance value of one or both conductors is positive with increasing temperature (PTC behavior) or is negative with increasing temperature (NTC behavior).

The fact that the current-limiting resistor for limiting the current supplied to the oscillator is designed for the microampere to milliampere range is also advantageous for the operation of the heating apparatus, the signal production in the oscillator, and the evaluation of the signal in the evaluation device.

Another embodiment that is advantageous for operation and safety includes the control device embodied to differentiate between irreparable and reparable fault states and a protective element is provided, which can be triggered by the control device and can bring the control device and/or the heating apparatus into an irreversible functionless state when an irreparable fault state is detected.

The operation and maintenance can be advantageously improved if the control device has a display device with which different operating states and/or fault states can be displayed. This can also contribute to increased safety.

A trigger circuit for the heating circuit can be designed for dynamic triggering and contribute to functional reliability.

The control device can have a memory device that stores preset values and/or evaluation programs that also contributes to the wide variety of possibilities for adaptation between the control device and the heating apparatus and to the possibilities for evaluating functional or fault states.

BRIEF DESCRIPTION OF THE DRAWINGS

This invention is explained in greater detail below in view of exemplary embodiments with reference to the drawings, wherein.

DETAILED DESCRIPTION OF THE INVENTION

Figure 1:
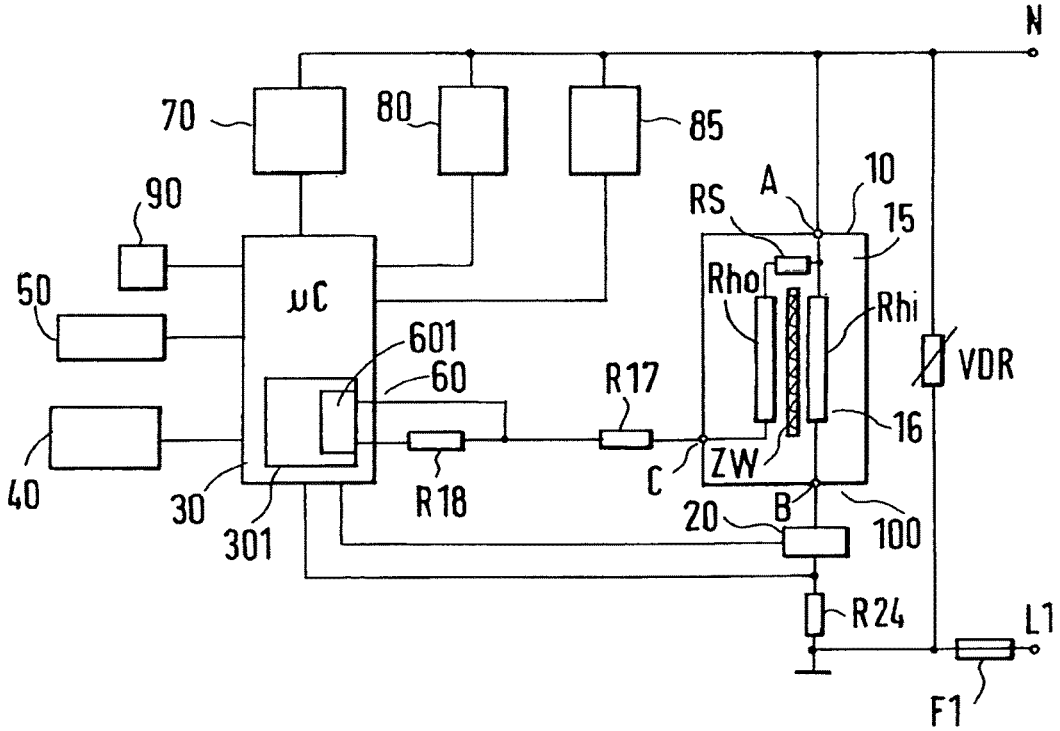
FIG. 1 shows a first exemplary embodiment for the design of a pliable heating device with a control device in a partial block circuit diagram.

FIG. 1 is a schematic view or depiction of a pliable heating device with a flexible heating apparatus 10 and a control device for controlling or regulating the heating operation and for monitoring functional states of the heating device including fault states, where individual circuit components are depicted as blocks.

The flexible, pliable heating apparatus 10, such as an electric blanket, a heated mattress cover, or a heating pad, has a flexible, pliable support 15, into which are embedded a flexible heating element with a heating conductor Rhi, a sensor conductor Rho, and electrically effective intermediate insulation ZW situated or positioned between them.

The control device, into which the heating element is integrated has a control unit 30 connected to the heating apparatus 10 via an electrical conductor device and via various electrical components, which control unit is connected on the one hand to a heating circuit 100, which includes the heating conductor Rhi in order to control or regulate the heating output, and is connected on the other hand to the sensor conductor Rho in order to monitor functional states of the heating apparatus 10. The control unit 30 is also connected via various inputs and outputs to other circuit components that are depicted as blocks in FIG. 1, namely an operating unit 40 with switches and/or buttons for a user to select settings, a display unit 50 for the optical, acoustical, and/or tactile depiction of information for the user or a maintenance person, a voltage supply unit 70 for the control unit 30 and possibly other components, a zero crossing detection circuit 80 for a supply voltage or grid voltage, a reference voltage-producing circuit 85 for producing a defined reference voltage, and a reset unit 90.

In addition, an oscillator 60 is at least partially integrated into the control unit 30, is connected to the sensor conductor Rho, and is connected at the other end to an evaluation device 301 that is likewise embodied in the control unit 30, with which the output signal of the oscillator 60 can be processed and evaluated. In the exemplary embodiment shown, the oscillator has an oscillator component 601 comprising components inside the control unit 30 and an external part situated outside the control unit 30, namely in the present case, an ohmic oscillator resistor R18. Various exemplary embodiments of oscillators are shown in German Patent Reference DE 10 2008 006 017 B4, which was mentioned at the beginning. In the exemplary embodiment according to FIG. 1, the design is achieved using components of this kind that are already built into the control unit 30 embodied in the form of an integrated circuit, such as a microcontroller. In this case, fundamental control parameters of the oscillator 60 can be predetermined in the control unit by software or programs, such as a fundamental frequency, a fundamental amplitude, and/or a curve shape (rectangular, sinusoidal, triangular, duty cycle, or the like). These fundamental parameters relate to a defined state of the pliable heating device such as when a heating apparatus 10 is disconnected or when a heating apparatus 10 is connected and in a defined fundamental state, which means that there are defined standard conditions for setting the fundamental parameters.

The oscillator 60 is connected via a series resistor R17 to the one end of the sensor conductor Rho while the other end of the sensor conductor Rho is connected via a sensor resistor RS to an end section of the heating conductor Rhi. Consequently, the sensor resistor RS is arranged in parallel with the intermediate insulation ZW of the heating element and in series with the insulator 60 via the sensor conductor Rho and the current-limiting resistor R17 and in the present case, is connected to the oscillator resistor R18. Consequently, the oscillator signal depends on the state of the heating element and changes with the electrical values of the heating element, particularly when there is a change in temperature, but also when there are other state changes such as breakage, short-circuiting, and aging.

In the exemplary embodiment shown, the current-limiting resistor R17 is situated or positioned outside a connection point C of the flexible heating apparatus 10 while the sensor resistor RS is situated or positioned on the flexible support 15, close to a connection point A of the heating conductor Rhi. It is also possible to select other positions, namely the arrangement of the current-limiting resistor R17 on the flexible support 15 or the arrangement of the sensor resistor RS outside the flexible support 15. Alternatively, both resistors RS, R17 can be situated or positioned on or outside the support 15. If instead of connecting the heating apparatus 10 by a fixed connection, as is also possible, a plug/coupling unit is used, then the sensor resistor RS and/or the current-limiting resistor R17 can be situated or positioned in the part of the plug/coupling unit affixed to the support 15 or in the detachable part of the plug/coupling unit situated or positioned outside the flexible support 15. If the sensor resistor RS and/or current-limiting resistor R17 is/are situated or positioned in the detachable part, then it/they can be removed, for example, before washing and protected from negative influences. In order to be situated or positioned in the separate part of the plug/coupling unit, they are embodied, for example, as four-poled.

In order to control or regulate the heating output, the heating circuit 100 that has the heating conductor Rhi contains a switch device 20 that is connected to the control unit 30 and can be controlled by the control unit 30. In order to regulate the heating output, a measurement current can be picked up from the heating circuit 100 at an additional measurement resistor R24 contained therein and can be supplied to the control unit 30 via circuit components. In a power cord, there is a fuse F1 that melts when exposed to excess current. In addition, as an additional protective measure, an excess voltage protection can be formed with a varistor VDR between the power cables N and L1.

Figure 2:
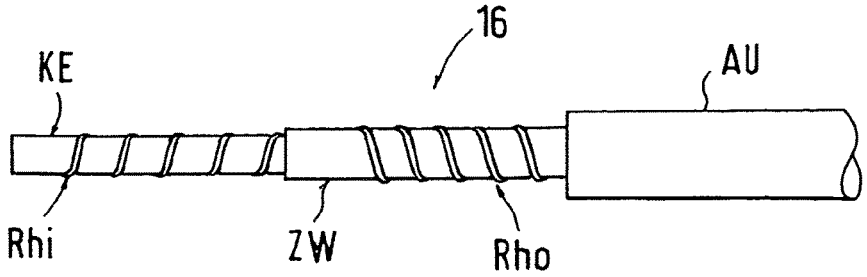
FIG. 2 shows one detail of a heating element embodied in the form of a heating cord.

As an exemplary embodiment for a heating element 16, FIG. 2 shows a heating cord with a central core KE, onto which the heating conductor Rhi is helically wound. The core KE with the heating conductor Rhi has the intermediate insulation ZW concentrically slid onto it, onto which the sensor conductor Rho is likewise helically wound. The intermediate insulation ZW and the sensor conductor Rho are encompassed or formed on the outside by an outer insulation AU. In the exemplary embodiment shown, the inner conductor is the heating conductor Rhi and the outer conductor is the sensor conductor Rho. Alternatively, the inner conductor can be the sensor conductor and the outer conductor can be the heating conductor.

In one exemplary embodiment, the resistance value of the heating conductor Rhi and of the sensor conductor Rho has a positive temperature coefficient (PTC behavior), so that with increasing temperature, the ohmic resistance value rises, while the ohmic resistance value of the intermediate insulation ZW has a negative temperature coefficient (NTC behavior) so that its resistance value decreases exponentially, for example, as the temperature increases. Alternatively, however, the heating conductor Rhi and/or the sensor conductor Rho can have NTC behavior and the intermediate insulation ZW can have PTC behavior. The other remaining combinations of the temperature behavior (PTC and NTC behavior) can also be used as further alternative embodiments. The respective temperature-dependent resistance behavior can be used as a sensor signal. The design also produces a capacitive resistance and an inductive resistance. The intermediate insulation ZW constitutes or forms a dielectric and, as is also customary in this connection, can be referred to as a dielectric resistor. The ohmic resistance of the intermediate insulation ZW can in turn, when operating with alternating current, be dependent on the frequency of the alternating current. The capacitive resistance or the inductive resistance depends on the winding density (the number of windings per unit length) of the heating conductor Rhi and of the sensor conductor Rho. In addition, the cross-sectional area and/or cross-sectional shape of the heating conductor Rhi or of the sensor conductor Rho can be chosen to be different, which makes it possible not only to vary their resistance, but also on the whole to achieve different ohmic, capacitive, and inductive resistance values of the heating element. Another possible embodiment for the heating cord comprises the core KE embodied in the form of or formed as tinsel wire. Tinsel wire conductors of this kind, such as composed of high-strength polyester as a base material and an arbitrary spun yarn have one advantage that they have a low impedance and favorable EMC/EMF values.

The intermediate insulation ZW is essentially used to detect localized places with excessive temperature of the heating element (hot spot identification) and has melting properties in the primary temperature detection range of usually 120 to 160° C., for example, so that a low-impedance electrical connection, for example a short-circuit, is produced between the heating conductor Rhi and the sensor conductor Rho and as a result, forms an overheating protection detector. Or the intermediate insulation ZW has non-melting properties, even in the higher temperature ranges to be detected. Then the low resistance values of the intermediate insulation ZW caused by the exponential temperature dependence are used for the monitoring function. Suitable materials for the intermediate insulation ZW include, for example, PVC (that melts at a low or a high temperature), polyethylene (PE), PES, PA, POM, TPU, PEEK, PPP, PPS, PSU, PEI, with or without glass or carbon fiber reinforcement, non-melting polyimides, or the like. Filler materials and additives are used in order to achieve the temperature-dependent resistance and conductivity behavior.

The design and function of the sensor conductor Rho and of the heating conductor Rhi can essentially correspond and be interchanged with one another. The current-carrying capacity of the two conductors can also be different. In particular, the sensor conductor Rho has a lower current-carrying capacity.

With the various selectable properties of the heating cord, it is possible to detect many different functional states of the heating apparatus in connection with the control device because these influence the electrical properties of the heating element differently.

Alternatively, it is also possible to use a heating element in the form of a flat design with a flat heating conductor Rhi and sensor conductor Rho and an intermediate insulation ZW situated or positioned between them.

Figure 3:
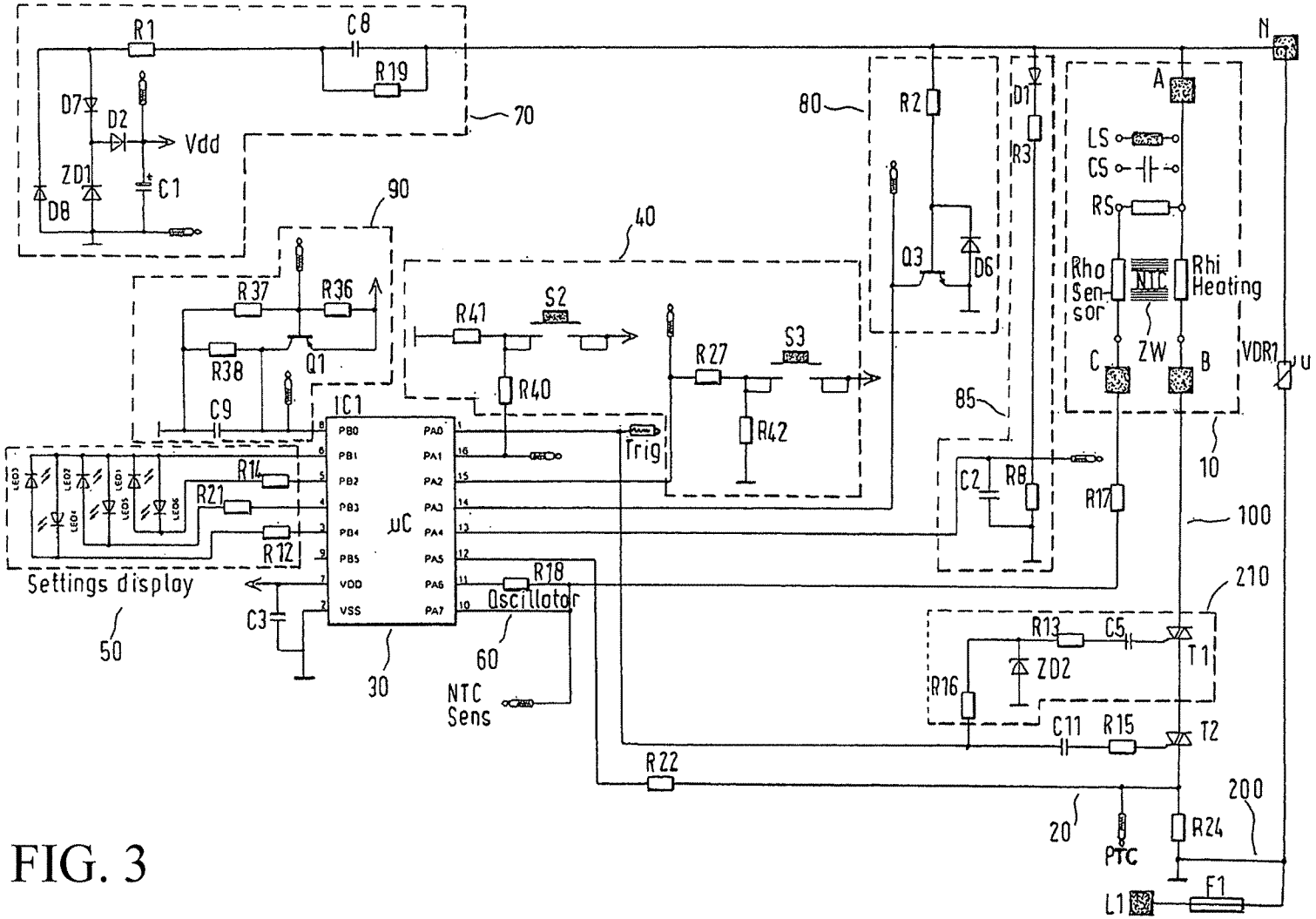
FIG. 3 shows a detailed depiction of a control device of the pliable heating device according to FIG. 1.

FIG. 3 shows a detailed exemplary embodiment of the exemplary embodiment according to FIG. 1. According to FIG. 3, instead of or in combination with the ohmic sensor resistor RS, a capacitive or inductive sensor resistor CS or LS can be provided. With the capacitive or inductive sensor resistor CS, LS, possibly in combination with the ohmic sensor resistor RS, it is also possible to differentiate between additional frequency-dependent properties of the heating element; in this case, it is advantageous if the control unit 30 for the oscillator 60 has various fundamental frequencies. The fundamental frequencies here can be predetermined as a function of various flexible heating apparatuses such as heating pads or electric blankets of different designs and different heating outputs. The adjustment of the respective most favorable fundamental frequency or also curve shape can be automatically predetermined as a function of the detected heating apparatus. Another embodiment comprises different fundamental parameters (such as frequency, curve shape, amplitude) that can be predetermined in order to detect different functional states. This produces other advantageous detection possibilities. For example, in order to detect different aging states, a different set of fundamental parameters for a detection measurement can be predetermined than for detecting a conductor break or short-circuit or for checking the operational reliability of the oscillator 60 itself or of another circuit component such as the switch device 20 in the heating circuit 100.

In addition, the ohmic, capacitive, and/or inductive sensor resistor RS, CS, or LS can be exactly matched to the properties of the heating apparatus 10 so that when there are changes to the electrical properties of the heating element by means of the oscillator 60 and the evaluation device 301, the range of maximum sensitivity with which the respective functional state can be detected is preserved. For example, the value of the ohmic sensor resistor RS lies in the range between one twentieth and one hundred percent of the ohmic resistance value of the intact intermediate insulation ZW at room temperature, such as between one twelfth and one half of it. For example, in a heating device, if the ohmic resistance value of the intermediate insulation ZW in the cold state (at room temperature) remains between 1 MΩ and 5 MΩ, then for example a resistance value of between 100 kΩ and 1 MΩ, is selected for the ohmic sensor resistor RS.

In addition, the current-limiting resistor R17, which is connected to the end of the sensor conductor Rho oriented away from the sensor resistor RS, CS, or LS and is connected to the external oscillator resistor R18, is selected so that the current flowing into the oscillator 60 from the sensor conductor Rho is limited to values from the μA range to the mA range. This results in low loads on the sensor conductor Rho and oscillator 60 and also produces advantageously evaluatable influences on the oscillator output signal, as the inventor has demonstrated in experiments. In this case, the changes in the amplitude, curve shape, or frequency of the oscillator output signal can each be evaluated in and of themselves or in combination with one another in the evaluation device 301.

If signal changes of the oscillator output signals cannot be unambiguously evaluated, then repeat measurements can be carried out in order to increase the reliability of the evaluation. The evaluation of a plurality of signals for a functional state can, for example, be carried out by statistical methods such as averaging, in which the average value obtained is compared to a plurality of measurements with a saved or calculated threshold value. In this case, the number of measurements can also be determined from the magnitude of the deviation between the measurements, for example, a standard deviation or a pairwise deviation. For the evaluation of the oscillator output signal, the control unit 30 can advantageously be provided with software that can also be embodied so that it remains subsequently modifiable with regard to the evaluation algorithms and parameters.

Another advantageous embodiment comprises even the measurement signal, which is picked up in the heating circuit 100 and is used for controlling or regulating the heating output, is supplied to the evaluation device 301 and with the latter, is taken into consideration along with the oscillator output signal in order to determine the respective functional state. In this way, when there is a change in the signal that is supplied via the sensor conductor Rho to the oscillator 60, it is possible to detect, for example, whether this signal is the result of a break in the heating conductor Rhi since in this case, no current flows through the heating conductor Rhi and as a result, there is no voltage drop or measurement current at the measurement resistor R24, whereas on the other hand, a current is in fact received via the sensor conductor Rho. If the sensor conductor Rho is broken, then no current or only a small amount of current is supplied to the oscillator 60, depending on the distance of the break point from the relevant connection point C, whereas a relevant flow of heat flows via the heating conductor Rhi and thus a measurement current can be picked up at the measurement resistor R24. In the event of an incorrectly plugged or unplugged connection coupling of the heating device or in the event of a break of both the heating conductor Rhi and the sensor conductor Rho, a current is not detected in either the sensor conductor Rho or the heating conductor Rhi. The oscillator output signal corresponds to that of a disconnected heating apparatus 10.

It is advantageous to operate the flexible heating apparatus 10 with alternating current. In this case, it is possible with the present design to evaluate both the positive half-wave of the supply voltage and the negative half-wave of the supply voltage. A separate evaluation of the positive and negative half-wave is possible. This has the advantage that functional states or fault states that particularly affect one half-wave can be separately evaluated without the output signal of the oscillator 60 influencing the other half-wave.

As FIG. 3 shows, the switch device 20 is equipped with a trigger circuit that produces a dynamic triggering of the switch element(s) in the heating circuit 100, namely in the present case, via the capacitor C11 and the resistor R15. The dynamic triggering of the switch element T2 embodied in the form of or formed as a triac has the advantage that in the event of a failure of the control unit 30, a triggering cannot take place due to its static fault state since a multiple triggering frequency relative to the network frequency is required for triac triggering.

The capacitive reactance Xc of the capacitor C11 determines the resulting triac gate trigger control currents. The switch element enables an output adjustment by pulse-width modulation (PWM). It is also possible to use switch elements in the form of thyristors, switching transistors, MOSFETs, IGBTs, relays, or the like in combination with one another.

As also shown in FIG. 3, the switch device 20 has a redundant switch unit 201 with a heating element T1, which is likewise situated in the heating circuit 100 and can have the same design as the above-mentioned switch element T2. In the present case, the switch element of the redundant switch unit 201 is also dynamically triggered, namely via the resistor R13 and the capacitor C5. In addition, a stabilizing Zener diode ZD2 and a resistor R16 are provided, which are connected to the triggering line between the control unit 30 and the switch element T2. The redundant switch unit 210 provides an additional way to switch off the heating circuit 100 in the event of a failure of the first switch element T2.

As also shown in FIG. 3, the operating unit 40 includes various manual input elements such as button elements, switch elements, and/or slider elements S2, S3 as well as additional circuit elements R27, R40, R41, R42. The display unit 50 includes several display elements in the form of light-emitting diodes (LEDs) and other circuit elements with which these LEDs are connected to the control unit 30. The display unit 50 can be used to display functional states including fault states to a user or maintenance person. It is also possible to display switching stages for the heating output. The voltage supply unit 70 includes a capacitive electronic current supply C8, with a discharge resistor R19 and voltage stabilization by R1, D2, D7, D8, C1, and a Zener diode ZD1. The zero crossing detection circuit 80 is used for zero voltage gate triggering of the switch elements T1 and T2, particularly in the case of triacs, and includes the resistor R2, the transistor Q3, and the diode D6. The reference voltage production circuit for detection of the reference voltage based on the current grid voltage includes the diode D1, resistors R3, R8, and a capacitor C2. The exemplary embodiment according to FIG. 3 also has a protective circuit 200 with the excess current protection device F1 and the (optional) excess voltage protection with the varistor VDR1.

Figure 4:
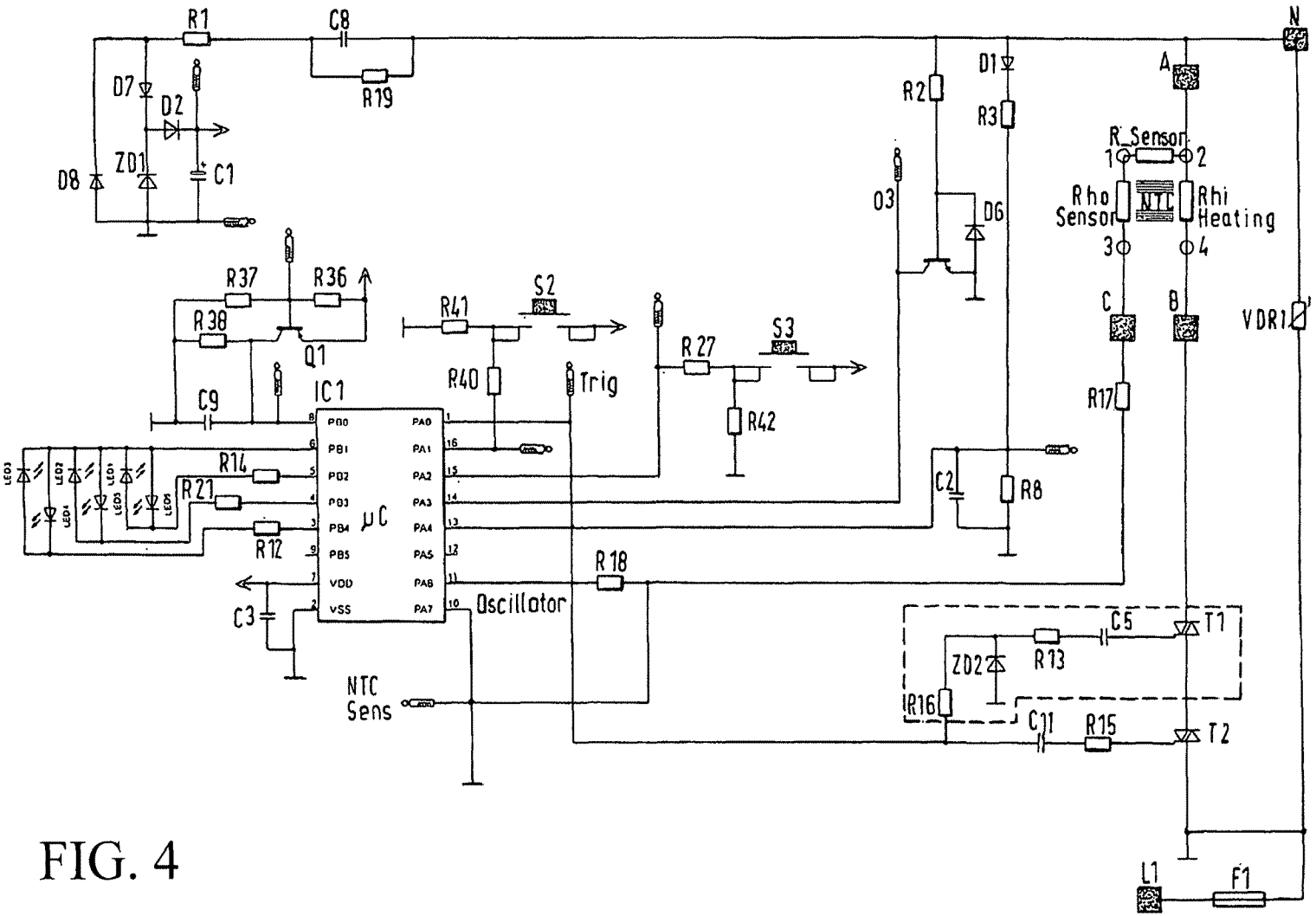
FIG. 4 shows another exemplary embodiment for a pliable heating device with a detailed depiction of a modified control device.

By contrast with the exemplary embodiment according to FIG. 3, in the exemplary embodiment shown in FIG. 4, the detection of a measurement signal in the heating circuit 100 for heating conductor temperature detection has been omitted.

Figure 5:
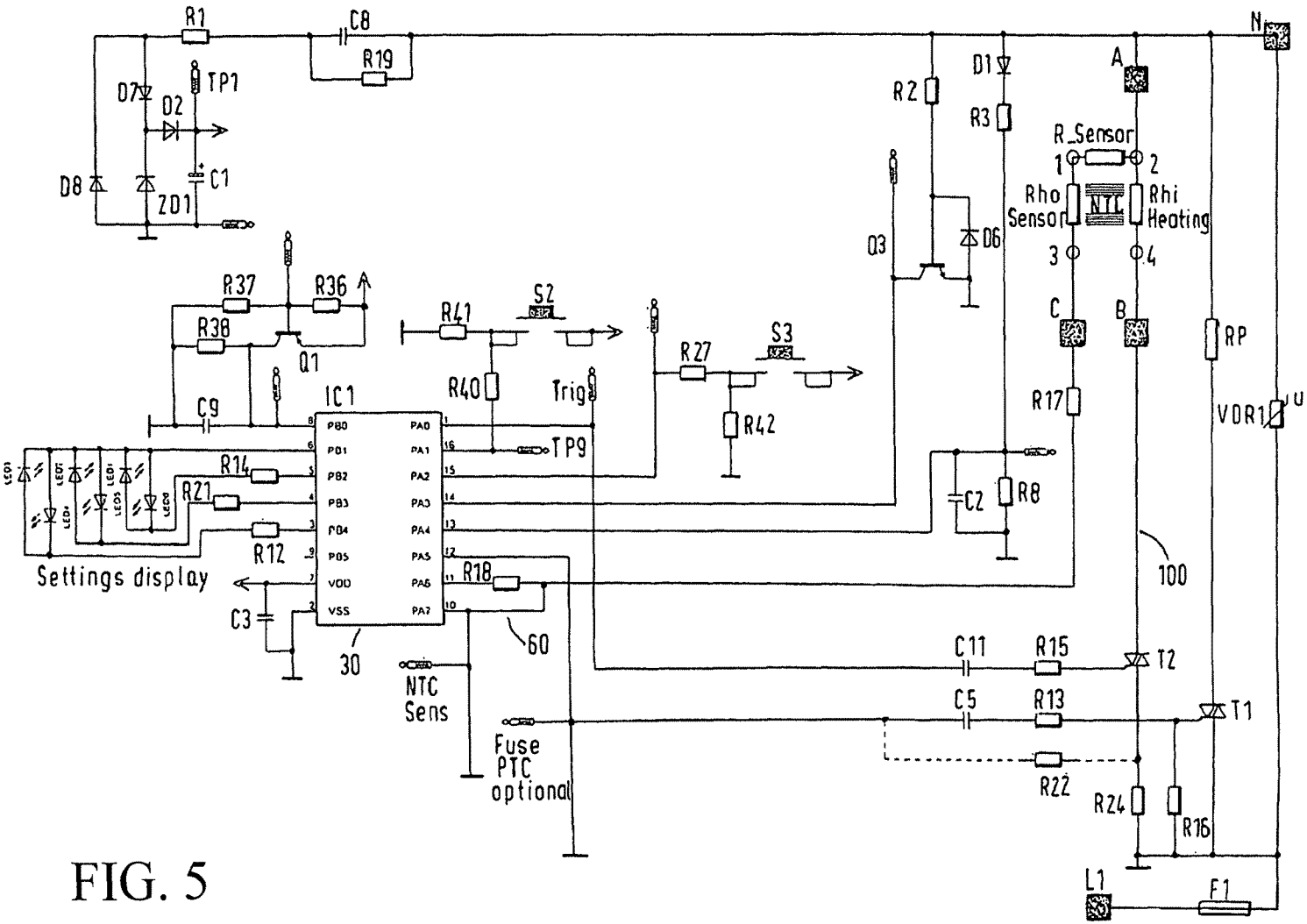
FIG. 5 shows another exemplary embodiment for a pliable heating device in a detailed depiction of another modified control device.

By contrast with the exemplary embodiment according to FIG. 3, in the exemplary embodiment shown in FIG. 5, an active safety shut-off of the second switch element T1 is provided. Instead of the reversible redundant load shedding by the switch elements T1 and T2 according to FIG. 3, in this exemplary embodiment, the switch element T1 is connected in parallel with the heating apparatus in the power connector in order to switch to an additional current path via a resistor RP so as to produce an overcurrent that causes the irreversible triggering of the fusible cut-out F1 at the power supply connector. The triggering line of the switch element T1 can optionally be connected to the measurement resistor R24 of the heating circuit 100 via a resistor R22. It is thus possible for the relevant connection of the control unit 30, for example embodied as or in the form of a microprocessor, to be simultaneously used for detecting the measurement signal in the heating circuit 100 and for the triggering of the switch element T1, thus requiring a smaller number of connections. Via the shared connection of the control unit 30, a regulating/control unit can produce the same control currents, for example with digital rectangular signals with a higher frequency for the triac T1 whereas the usual 50 or 60 Hz signals would not normally be sufficient for a gate trigger current. This suppresses the measurement signals of the PTC heating circuit 100 that are limited by the resistor R22 (signal overlap), which signals are no longer needed at this point. If, however, additional signal inputs or signal outputs are provided, then the path for the measurement signal and the triggering of the triac T1 can also be embodied separately.

Figure 6:
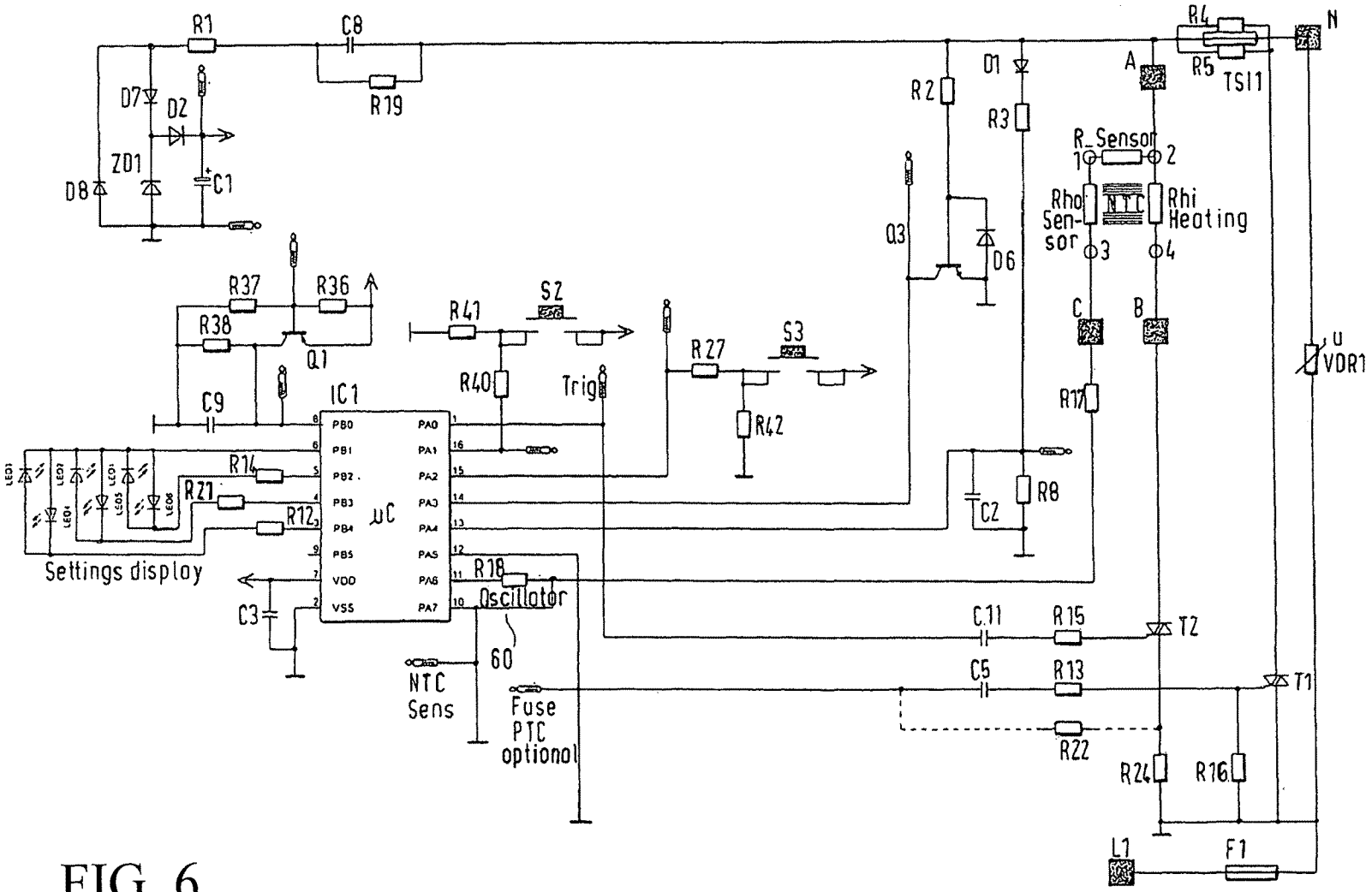
FIG. 6 shows another exemplary embodiment for a pliable heating device in a detailed depiction of yet another control device.

FIG. 6 shows a variant of the exemplary embodiment shown in FIG. 5. In this case, instead of the resistor RP in the power supply line, a thermal link TSI1 is provided that is thermally coupled to heater elements R4 and R5. In the event of a fault, the heater elements R4 and R5, through their thermal coupling to the thermal link TSI1, cause the latter to fuse and thus result in a delayed irreversible triggering of a device shut-off in the event of a fault. This also causes the triggering of the switch element T1 by the control unit 30, particularly if a fault state is detected via the output signal of the oscillator 60, for example, in a fashion similar to the one also provided in the exemplary embodiment according to FIG. 5.

As demonstrated above, the heating device on the one hand has a monitoring system with a differentiated detection of functional states, in particular fault states, and on the other hand, in combination with the monitoring device, has different triggering devices via which it is possible to react selectively and quickly to detected function states, in particular the fault states, by controlling or reducing the heating output or by switching off the heating device, especially the heating apparatus. In this connection, it is also possible to activate the display unit 50. With an advantageous embodiment, it is also possible to save important fault states.

In addition to monitoring fault states, the monitoring device also performs plausibility checks, for which purpose signals detected in the control circuit or regulating circuit can be additionally supplied to the evaluation device 301, such as the measurement signal picked up in the heating circuit 100 or also signals of the zero crossing detection circuit 80, of a grid frequency detection (50 or 60 Hz), of the reference voltage production circuit 85, and/or of the supply voltage. Even when faults have just begun, warnings can be issued and displayed.

With the ohmic resistance of the intermediate insulation ZW that decreases in an exponentially quick fashion with the temperature when it is embodied with NTC behavior, the current thus flowing through the intermediate insulation ZW correspondingly increases in comparison to the portion of the current flowing via the ohmic sensor resistor RS, therefore resulting in a correspondingly sensitive signal change at the oscillator 60. The heating output, however, can be exactly controlled as a result of the PTC temperature behavior of the heating conductor Rhi. It is thus possible to carry out a selective control or regulation in the event of a fault even before a serious fault state occurs that would necessitate a complete shut-down of the device and possibly an irreversible safety shut-off. A precise reaction to functional states and possible fault states can be carried out through signal filtering of the oscillator output signal by hardware or software filters or by programs in order to eliminate interference signals and to obtain a high degree of precision of the signals for the evaluation. This avoids unnecessary fault shut-downs. When operating with a different grid frequency (50/60 Hz), it is possible to adapt the fundamental parameters of the oscillator. First, the grid frequency is automatically detected. It is thus possible to also take into account possible effects of the frequency on the ohmic, capacitive, and/or inductive resistance behavior of the intermediate insulation ZW. Another possible adaptation is in the external resistor R18 of the oscillator 60.

The low currents through the current-limiting resistor R17, in addition to a favorable signal detection by the control unit 30, also result in a low load on the sensor conductor Rho, thus also achieving a long resistance to aging and a low incidence of corrosions. At the same time, this also yields the advantage of low material requirements for the conductor.

The heating device with the above-described monitoring system, in addition to the detection of functional states, in particular fault states, also permits plausibility checks to be performed. Various measures comprise:

- device type recognition (is permitted to operate the heating apparatus 10 on the control device or the operating unit);
- if the heating device is properly connected to the supply voltage by the plug connection and if an interruption has occurred;
- if there is an interruption in the sensor branch with the sensor conductor Rho;
- if rapid heating is provided, this can be suppressed once a fixed heating temperature (of approx. >33° C.) is reached or upon detection of a hot spot excess temperature (such as greater than 80° C.);
- if a fault is detected, the heating circuit can be interrupted;
- in the event of a short-circuit between the heating conductor Rhi and sensor conductor Rho, this can be detected, for example, by the increased sensor current and the device can be switched off;
- temperature signals can be detected via the sensor branch and the heating circuit 100 and range values can be monitored;
- faults of the oscillator 60 can be detected through plausibility checks in the sensor branch;
- it is possible to detect a faulty measurement resistor R24 by comparing signals of the heating circuit 100 and of the sensor branch by the oscillator 60;
- a calibration can be monitored and detected by measurements in the sensor branch and the heating circuit 100;
- monitoring can be carried out in 50 Hz and 60 Hz grid operation;
- it is possible to monitor the sensor branch during the positive and negative grid half-waves;
- it is possible to monitor the grid voltage range;
- it is also possible to monitor the redundant switch unit 210 of the heating circuit 100 by using the sensor branch in connection with the heating circuit 100.

For safety reasons, during the operation of the heating device, the reference voltage via the reference voltage production circuit 85 is generally checked first, then the signals of the sensor branch are checked for fault states and plausibility, and only after this is the heating output switched on, provided that this is permitted, it being possible to measure and check heating temperature signals if necessary.

If the oscillator 60 is running without a plugged-in heating apparatus 10 or with an interruption of the heating conductor Rhi and sensor conductor Rho, then this generally results in the maximum dynamically changing measurement voltage in the output signal of the oscillator since no damping takes place, as long as the oscillator 60 does not have a fault.

When heating begins (room temperature), the primary action is exerted by the resistance value of the sensor resistor RS. When different sensor resistors (RS, CS, or LS) are selected for different heating apparatuses, it is possible to determine the type of heating device or heating apparatus, for example through comparison to a temperature measurement in the heating branch. Falling or rising temperatures at the sensor conductor Rho, for example when it is embodied with PTC behavior, can be registered due to changes in the damping of the oscillator output signal. This enables a range monitoring of the temperature.

With hot spot faults, the load on the dampable oscillator 60 changes excessively due to the presence of non-linear signals, which indicates the occurrence of this fault. A hot spot measurement is advantageously carried out when the heating output is switched off. Based on the measurement values obtained, an intervention is carried out in the control device in order to limit or reduce the temperature or to switch off the device. The switching-off procedure can be carried out in a reversible or irreversible way. When embodied with a memory unit, it is possible to store fault information for maintenance persons. It is also possible for messages to be shown on the display unit. In addition, with less serious fault states, it is possible to carry out suitable interventions into the control or regulation of the heating output, such as occasionally reducing the power supply or switching off critical surface regions of the heating device when it is embodied with a plurality of heating circuits in order to put less strain on the heating device and to slow the aging process.

An interruption of the sensor conductor Rho can be detected through a change in the damped oscillator output signal. Detection of this fault state is possible through comparison, for example, to a temperature detection of the heating conductor Rhi with PTC behavior.

The functional testing with a redundant switch unit 210 is carried out by reciprocally switching the switch elements on and off and checking the flow of heat in the heating circuit 100 and by taking the oscillator output signal into account.

Through a definite change of the frequency of the oscillator 60 by the control unit 30, it is possible in known sensor resistors RS, CS, LS, which can also be provided in combination with one another or with batteries or battery packs, it is possible to determine characteristic output signals of the oscillator 60 in order to be able to determine and identify the type of heating apparatus 10. With incorrect combinations of the control device and heating apparatus 10, the device can be prevented from operating and a fault display can be produced.

If no measurement signal is picked up in the heating circuit 100, then with regard to the properties of the sensor conductor Rho (such as PTC behavior) for temperature regulation signals, the sensor branch via the oscillator output signal can be used for triggering the switch device in the heating circuit 100.

A control or regulation of the heating output and also a state monitoring and fault monitoring can be carried out in a zone-dependent fashion inside the heating apparatus if cord sections of the heating element are arranged more or less close to one another or if a plurality of heating circuits are provided.

The control device can be provided with a memory unit that stores fixed and/or dynamic programming values, parameter values, and reference values of the dampable (controllable) oscillator, calibration data, device reference data, set-point values, threshold values, and the like. The calibration data include, for example, correction values for the grid voltage frequency, tolerances of the sensor conductor Rho and of the heating conductor Rhi, the fundamental frequency(ies) of the oscillator 60, voltage tolerances, and the like.

The zero crossing signals of the control device can be used for detecting the grid frequency and possibly for adapting the signals of the dampable oscillator as well as for avoiding functional interruptions and possibly also for a clock synchronization. In addition, the zero crossing triggering of the switch elements T1, T2, in particular triacs, is derived from the zero crossing signals. Furthermore, the zero crossing signals can be taken into account in the evaluation device 301 when there are changes in connection with the hot spot detection since the intermediate insulation ZW can undergo a possibly frequency-dependent change. Put simply, the zero crossing detection circuit 80, which in the exemplary embodiments shown includes the resistor R2, the transistor Q3, and the diode D6, can also be solely composed of or of a grid series resistor. The typical grid frequency differentiation 50/60 Hz is made through comparison with the (optionally quartz-stabilized) clock frequency of an oscillator or an optional signal generator of a real-time clock module or with fixed or variable charging times of RC components in a software-based fashion or the like.

The invention claimed is:

1. A pliable heating device having a flexible electrical heating apparatus (10) operated by a control device and which has at least one flexible heating element (16) connected to a flexible support (15) and that has a heating conductor (Rhi) situated in a heating circuit (100), and a flexible sensor conductor (Rho) separated from said heating conductor by an intermediate insulation (ZW), having a dampable oscillator (60) contained in the control device and connected to the sensor conductor (Rho) and an output signal variable as a function of various functional states of the heating apparatus (10), the functional states detected by the sensor conductor (Rho), and having an evaluation device (301) by which fault states can be detected from the output signal, the pliable heating device comprising: the sensor conductor (Rho) connected at one end to the heating conductor (Rhi) via an impedance device which is connected in series and comprises at least an ohmic sensor (RS), a capacitive sensor (CS), and/or an inductive sensor (LS) resistor (RS) and is connected at an other end to the oscillator (60) via an ohmic current-limiting resistor (R17), wherein the current-limiting resistor (R17) for limiting the current supplied to the oscillator (60) is designed for a microampere to a milliampere range.

2. The pliable heating device according to claim 1, wherein the intermediate insulation (ZW) has NTC resistance characteristics with an ohmic resistance that decreases exponentially as a function of the temperature or PTC resistance characteristics with an ohmic resistance that increases as a function of the temperature.

3. The pliable heating device according to claim 2, wherein the control device has a control unit (30) formed as an integrated circuit and at least a part (601) of the oscillator (60) comprises the integrated circuit.

4. The pliable heating device according to claim 3, wherein the oscillator (60) has an external oscillator resistor (18) externally connected to the integrated circuit.

5. The pliable heating device according to claim 4, wherein a fundamental frequency of the oscillator (60) can be predetermined by the control unit (30).

6. The pliable heating device according to claim 5, wherein the evaluation device (301) is supplied with a measurement signal picked up in the heating circuit (100) and the evaluation device (301) detects fault states as a function of both the output signal of the oscillator (60) and the measurement signal that is picked up in the heating circuit (100).

7. The pliable heating device according to claim 6, wherein the measurement signal is a current measurement signal picked up at a measurement resistor (R24) of the heating circuit (100) and is used in the control unit (30) for controlling or regulating the heating output by triggering a switch device (20) in the heating circuit (100).

8. The pliable heating device according to claim 7, wherein the sensor resistor (RS) and/or the current-limiting resistor (R17) each is positioned on the flexible support (15) or in a detachable part of a plug/coupling unit mounted on it.

9. The pliable heating device according to claim 8, wherein an ohmic resistance value of the sensor resistor (RS) is in a range between one hundredth or one twentieth and one hundred percent of the ohmic resistance value of the intact intermediate insulation (ZW) at room temperature.

10. The pliable heating device according to claim 9, wherein the heating conductor (Rhi), the sensor conductor (Rho), and the intermediate insulation positioned between them (ZW) are parts of a heating cord with an outer insulation on an outside.

11. The pliable heating device according to claim 9, wherein the heating conductor (Rhi) and/or the sensor conductor (Rho) each has a temperature-dependent ohmic resistance behavior and a thermal response of the resistance value of one or both conductors (Rhi, Rho) is positive or negative with increasing temperature.

12. The pliable heating device according to claim 11, wherein the control device differentiates between irreparable and reparable fault states and a protective element can be triggered by the control device and can bring the control device and/or the heating apparatus into an irreversible functionless state when an irreparable fault state is detected.

13. The pliable heating device according to claim 12, wherein the control device has a display device with which different operating states and/or fault states can be displayed.

14. The pliable heating device according to claim 13, wherein a trigger circuit for the heating circuit (100) has dynamic triggering.

15. The pliable heating device according to claim 14, wherein the control device has a memory unit that stores preset values and/or evaluation programs.

16. The pliable heating device according to claim 1, wherein the control device has a control unit (30) formed as an integrated circuit and at least a part (601) of the oscillator (60) comprises the integrated circuit.

17. The pliable heating device according to claim 16, wherein the oscillator (60) has an external oscillator resistor (18) externally connected to the integrated circuit.

18. The pliable heating device according to claim 16, wherein a fundamental frequency of the oscillator (60) can be predetermined by the control unit (30).

19. The pliable heating device according to claim 1, wherein the evaluation device (301) is supplied with a measurement signal picked up in the heating circuit (100) and the evaluation device (301) detects fault states as a function of both the output signal of the oscillator (60) and the measurement signal that is picked up in the heating circuit (100).

20. The pliable heating device according to claim 19, wherein the measurement signal is a current measurement signal picked up at a measurement resistor (R24) of the heating circuit (100) and is used in the control unit (30) for controlling or regulating the heating output by triggering a switch device (20) in the heating circuit (100).

21. The pliable heating device according to claim 1, wherein the sensor resistor (RS) and/or the current-limiting resistor (R17) each is positioned on the flexible support (15) or in a detachable part of a plug/coupling unit mounted on it.

22. The pliable heating device according to claim 1, wherein an ohmic resistance value of the sensor resistor (RS) is in a range between one hundredth or one twentieth and one hundred percent of the ohmic resistance value of the intact intermediate insulation (ZW) at room temperature.

23. The pliable heating device according to claim 1, wherein the heating conductor (Rhi), the sensor conductor (Rho), and the intermediate insulation positioned between them (ZW) are parts of a heating cord with an outer insulation on an outside.

24. The pliable heating device according to claim 22, wherein the heating conductor (Rhi) and/or the sensor conductor (Rho) each has a temperature-dependent ohmic resistance behavior and a thermal response of the resistance value of one or both conductors (Rhi, Rho) is positive or negative with increasing temperature.

25. The pliable heating device according to claim 1, wherein the control device differentiates between irreparable and reparable fault states and a protective element can be triggered by the control device and can bring the control device and/or the heating apparatus into an irreversible functionless state when an irreparable fault state is detected.

26. The pliable heating device according to claim 1, wherein the control device has a display device with which different operating states and/or fault states can be displayed.

27. The pliable heating device according to claim 1, wherein a trigger circuit for the heating circuit (100) has dynamic triggering.

28. The pliable heating device according to claim 1, wherein the control device has a memory unit that stores preset values and/or evaluation programs.

* * * * *